US005355911A

United States Patent [19]

Kuster et al.

[11] Patent Number: 5,355,911

[45] Date of Patent: Oct. 18, 1994

[54] WEAVE SHED FORMATION APPARATUS WITH INDIVIDUAL HEDDLE SELECTOR CONTROL

[75] Inventors: Heinz Kuster; Stephan Kuster, both of Sandpoint, Id.

[73] Assignee: Asten Group, Inc., Charleston, S.C.

[21] Appl. No.: 959,967

[22] Filed: Oct. 13, 1992

Related U.S. Application Data

[63] Continuation of Ser. No. 832,350, Feb. 7, 1992, Pat. No. 5,183,081.

[51] Int. Cl.[5] ..... D03C 3/20; D03C 13/00

[52] U.S. Cl. ..... 139/55.1; 139/85; 139/59; 139/455; 139/383 AA

[58] Field of Search ..... 139/59, 455, 11, 55.1, 139/383 AA, 317, 320, 335, 93, 85; 28/141

[56] References Cited

U.S. PATENT DOCUMENTS

| | | | |
|---|---|---|---|
| 3,004,562 | 10/1961 | Kronoff . | |
| 3,456,691 | 7/1969 | Schneider . | |
| 3,500,872 | 3/1970 | Hopf . | |
| 3,794,082 | 2/1974 | Kuster et al. . | |
| 3,810,492 | 5/1974 | Lauritsen . | |
| 3,835,894 | 9/1974 | Speich . | |
| 3,865,148 | 2/1975 | Wolfgang et al. . | |
| 3,884,272 | 5/1975 | Brenner et al. . | |
| 3,918,500 | 11/1975 | Katsumata | 139/59 |
| 4,071,053 | 1/1978 | Santucci et al. . | |
| 4,116,242 | 9/1978 | Bucher | 139/59 |
| 4,120,326 | 10/1978 | Bezstarosti et al. . | |
| 4,150,698 | 4/1979 | Griffith . | |
| 4,416,310 | 11/1983 | Sage | 139/59 |
| 4,513,789 | 4/1985 | Bowen, Jr. et al. . | |
| 4,572,247 | 2/1986 | Speich . | |
| 4,739,806 | 4/1988 | Palau et al. | 139/455 |
| 4,969,490 | 11/1990 | Seiler | 139/455 |
| 5,183,081 | 2/1993 | Kuster et al. | 139/383 AA X |

FOREIGN PATENT DOCUMENTS

| | | | |
|---|---|---|---|
| 0107099 | 9/1983 | European Pat. Off. | 139/455 |
| 0304985 | 3/1989 | European Pat. Off. . | |
| 0440595 | 8/1991 | European Pat. Off. . | |
| 3524569 | 1/1987 | Fed. Rep. of Germany . | |
| 4026187 | 12/1991 | Fed. Rep. of Germany . | |

OTHER PUBLICATIONS

PCT Search Report For International Application No. PCT/US92/08699.

*Primary Examiner*—Andrew M. Falik

*Attorney, Agent, or Firm*—Volpe and Koenig

[57] ABSTRACT

A shed formation apparatus having increased flexibility and speed. The shed formation apparatus is comprised of a plurality of movable heddles which are connected to a plurality of heddle selectors by a first plurality of control leads. The heddle selectors are movably connected to a plurality of heddle selector controllers which include stoppers to retard the movement of the heddle selectors. A second plurality of control leads are attached to the heddle selectors. A repeat pattern output apparatus determines the movement of the second plurality of control leads and the attached heddle selectors, and selectively activates the stoppers.

5 Claims, 2 Drawing Sheets

WEAVE SHED FORMATION APPARATUS WITH INDIVIDUAL HEDDLE SELECTOR CONTROL

CROSS-REFERENCE TO RELATED APPLICATIONS

This is a continuation of application Ser. No. 07/832,350 filed Feb. 7, 1992 now issued as U.S. Pat. No. 5,183,081.

BACKGROUND OF THE INVENTION

1. Field of the Invention

The present invention relates generally to a shed format ion device for use in weaving. More particularly, the present invention relates to a shed formation device which is particularly useful in weaving narrow strips of fabric. Most particularly, the present invention relates to a shed forming device which is useful in an automatic seaming apparatus which is used to join the fabric ends to render the fabric endless.

2. Description of Prior Art

It is known to join woven fabrics in order to render them endless. Likewise, it is known to join the ends of a woven fabric through a process of reweaving. In the known processes, the ends of the fabric to be joined are processed so as to produce a yarn fringe which is comprised of yarns from the fabric body. The fringe yarns from each end are then interwoven, generally in the same repeat pattern as the remainder of the fabric, with a system of yarns selected in accordance with the original yarns that were interwoven with the fringe. Through this reweaving process, the resulting fabric is endless and has the same general construction throughout its length.

In the prior art, it is been known to join the fabrics through manual procedures , semiautomatic procedures and automatic procedures. In connection with forming the weaving shed, standard loom harnesses, dobby movements and a Jacquard movement have been utilized to form the shed. Although the semiautomatic and automatic devices of the prior art have produced some improvement over the manual procedure, the prior art devices exhibit three principal flaws . One, the shed formation devices do not easily accommodate changes in the weave pattern. Two, the join speed of the prior art devices is limited by the speed of the shed formation. Three, the need for mechanical interconnection, generally, means that the shed formation control device and the actual shed formation apparatus must be positioned close to each other.

It is the object of the present invention to provide a shed formation apparatus that can easily accommodate a change of weave patterns and can achieve shed formation speeds not available with the prior art devices.

SUMMARY OF THE INVENTION

The present invention provides a shed formation apparatus having increased flexibility and speed. The shed formation apparatus is comprised of a plurality of movable heddles which are connected to a plurality of moveable heddle selectors by a first plurality of control leads. Heddle selector controllers, which include stopper means to retard the movement of the heddle selectors, are connected to the selector. A second plurality of control leads are attached to the heddle selectors opposite the first plurality. Repeat pattern output means determines the movement of the control leads and the attached heddle selectors, and selectively activates the stopper means.

In order to provide sufficient space for the controllers, the control leads may be passed through a first harness means to increase the spacing therebetween and then passed through a second harness means to reduce the spacing therebetween.

DESCRIPTION OF THE PREFERRED EMBODIMENT

Figure 1:
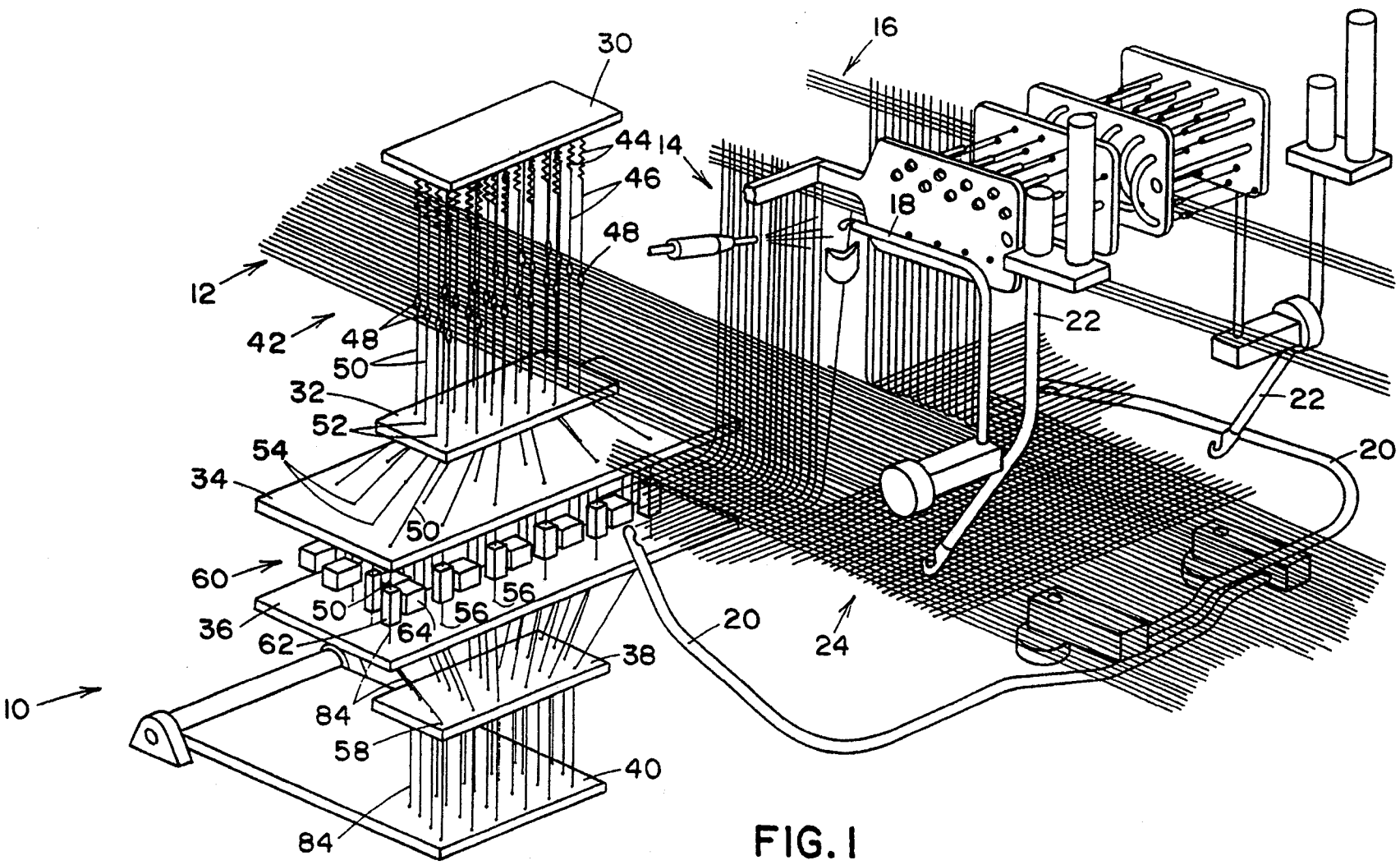
FIG. 1 is a perspective view of a shed formation apparatus in accordance with the present invention retrofitted to a known automatic seaming apparatus.

The preferred embodiment will be described with reference to the drawing figures.

With reference with FIG. 1, the shed formation apparatus 10 will be described in more detail. It will be recognized by those skilled in the art that the apparatus 10 in FIG. 1 is shown without any means of securement. It is shown in this manner for the purpose of illustration and it is expected that the fixed elements of the apparatus will be secured in accordance with the configuration of the weaving device into which it is incorporated. The weaving apparatus shown in FIG. 1 is described in U.S. Pat. No. 5,027,483 which is commonly assigned and incorporated herein as if fully set forth.

For the purpose of a general understanding of the process, the process is briefly described. The ends of the fabric are presented on either side of auxiliary yarns 12 with the prepared fringe 14 comprised of a plurality of yarns which are retained in their relative positions by the ribbon 16. As a result of manipulation of the ribbon 16, individual fringe yarns 14 are released and presented to a transfer arm 18. The transfer arm 18 will position the yarn 14 below the surface of the fabric. As a result of the shedding apparatus, the yarns 12 will be manipulated to form a shed in accordance with the fabric repeat pattern. Since the weaving takes place beneath the plane of the yarns, the shed is formed downwardly. The interlacing arm 20 will accept the yarn 14 from the transfer arm 18 and will interweave it with the yarns 18. After the transfer arm 12 has traversed the shed and is against the fell of the cloth, an extractor arm 22 will grip the yarn and pull it against the fell and through to one side of the fabric so that it may be ultimately trimmed. In the complete operation, a beat up mechanism is provided, however, it is not shown here for the sake of clarity. As this process continues, the joint area 24 will be completed and the resultant endless fabric will have a common weave structure throughout.

Still with reference to FIG. 1, the shed formation apparatus 10 will be further described. Apparatus 10 has a plurality of fixed plates 30, 32 , 34 , 36 and 38 and a moveable shed formation plate 40. All of the fixed plates are at fixed distances from each other. As noted previously, the specific arrangement for fixing the plates relative to each other will depend on the weaving apparatus. In some instances, it is expected that the illustrated arrangement will be inverted. In order to facilitate an understanding of the invention, it will be beneficial to discuss the purpose of the plates prior to discussing operation of the shedding apparatus.

Plates 30 and 32 are set at a fixed distance from each other and are positioned so that the heddles 42 will depend from the fixed plate 30 with the mail 48 positioned in plane of the yarns 12. In the preferred embodiment, each of the heddles 42 is of the type commonly associated with a Jacquard mechanism. The heddles 42 will be described in more detail with respect to FIG. 3. In general, the end 44 of the heddle is spring loaded and secured to the underside of plate 30 by a first lead 46. Each second lead 50 passes through one of the apertures 52 in plate 32. Each lead 50 continues through a respective aperture 54 in plate 34. As can be seen from the illustration, the plate 34 has a substantially larger area than the plate 32 and the apertures 54 are spaced further apart than the apertures 52 and plate 32. As a result, the leads 50 are defused over a larger area as they pass through plate 34.

Still with reference to FIG. 1, the plates 34 and 36 are at a fixed distance with respect to each other. At present, it is preferred that the plates 34 and 36 be equal in area with the respective apertures 54 and 56 on centerline with each other. The second lead 50 terminates at one end of the selector 80, and a third lead 84 is attached to the other end of the selector 80, see FIGS. 4 and 5. Each third lead 84 passes through its respective aperture 56, through the respective aperture 58 in plate 38 and is terminated at shed formation plate 40. As can been seen from FIG. 1, plate 38 has an area which is substantially equal to that of plate 32. The spacing of the apertures 58 corresponds generally to the spacing of apertures 52. Since the plate 38 has a smaller area than the plate 36, the leads 84 will be concentrated as they pass through the apertures 58. Accordingly, plate 34 will cause a diffusion of the second leads 50 and plate 38 will cause a concentration of third leads 84.

Before turning to a detailed description of additional elements of the invention, it is believed that a description of shed formation with this apparatus will benefit an understanding of the invention. Still with reference to FIG. 1, the movable plate 40 is moved in response to the repeat pattern which is required by the weave. Since the interweaving arms of the present weaving apparatus are generally below the plane of the fabric being joined, the shed will be formed beneath the plane of the yarns 12. As is known to those skilled in the art, each yarn 12 will be threaded through the respective mail 48 of a given heddle. Movement of the heddle will position the yarns 12 in the proper shed position.

If we assume an initial position with all of the auxiliary yarns 12 in a common plane, all of the mails 48 will also be in a common plane. In order to form a shed, the moveable shed formation plate 40 will move downwardly. As a result of this movement, the third lead 84 will move downwardly and cause a resultant downward movement of the mails 48 and extension of the spring 44. After plate 40 has completed its movement, selected controllers 60 will be activated. The selected controllers will be determined in accordance with the weave pattern as will be explained hereinafter. As soon as the selected controllers 60 have been activated, the moveable plate 40 will be permitted to return to its initial position. As a result of this movement, each yarn which is not associated with an activated controller will return to the original plane of the auxiliary yarns by the contraction of spring 44. Those yarns which have been selected will remain in a down position. After interweaving of the selected yarn has been completed, the moveable plate 40 will be activated and the selection process will be repeated. In the event that the repeat pattern does not require any change in the position of a previously selected yarn, no further activity will take place with respect to that yarn. In the event that a previously non-selected yarn is now a selected yarn, the weave pattern information will cause actuation of the associated controller 60. Accordingly, the moveable plate 40 will act upon each of the third leads 84 at each and every shedding, however, the controllers 60 will only be activated as needed. The information regarding the weave pattern must include a repeat pattern output means for selectively activating the controllers 60. However, the specific weave pattern output means is not critical to the invention. Those familiar with Jacquard movements will recognize that such a shed formation apparatus may be controlled by punch cards, tape or a computerized information source. Any of these weave patterns information output means will work with the present invention so long as the weave pattern information is presented in a form which will cause switching of the controllers 60. If one considers a standard Jacquard device, the yarn control information would not pass directly to the heddle, instead, the selected heddle information would be passed directly to a switching mechanism which will activate the selected controllers 60. The moveable plate 40 will be activated on each shedding pass and does not require specific control other than sequential timing in coordination with the selector operation.

Figure 2:
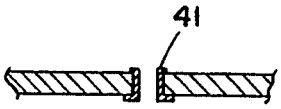
FIG. 2 is a fragmentary section of a typical plate which illustrates a yarn guide in accordance with the present invention.

With reference to FIG. 2, there is shown a typical aperture through one of the plates 30 through 40. It is expected that each of the plates will be formed of steel or some other metal. Since all of the leads will be subject to abrasion, it is preferred that each of the apertures be provided with a ceramic eyelet 41. Such eyelets are well known in the art and are frequently used as thread guides.

Figure 3:
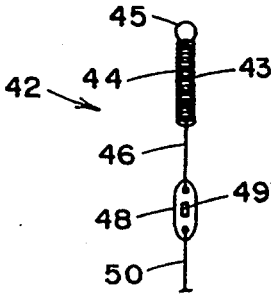
FIG. 3 illustrates a yarn heddle in accordance with the present invention.

With respect to FIG. 3 , there is shown a typical heddle 42. Heddle 42 is very similar to those which are generally associated with Jacquard movements, however, in the presently preferred embodiment, the second lead 50 is longer than that normally associated with the Jacquard heddle. Typically, such a heddle has a sleeve encased spring 44 at one end thereof. Generally, the spring terminates at one end in a mounting loop 45 and at the other end in a first lead 46. The loop 45 is dimensioned so as to abut the sleeve 43 and permit elongation of the spring 44 as a result of movement of the first lead 46. The first lead 46 is attached to one end of the mail 48. The second lead 50 is attached to the other end of the mail 48. As is common in the art, mail 48 includes an aperture 49 through which the yarn is threaded.

Figure 4:
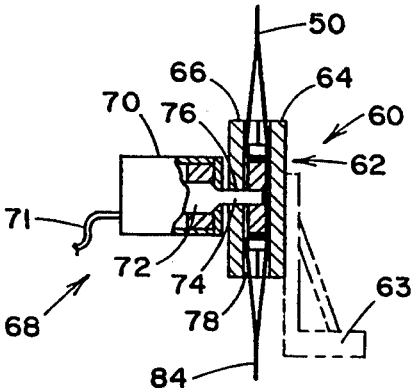
FIG. 4 illustrates, in section, the assembly of a controller, including the guide, a heddle selector and a stopper mechanism, in accordance with the present invention.

With respect to FIG. 4, there is illustrated a controller 60 in accordance with the presently preferred embodiment. The controller 60 is comprised of a guide 62 which is further comprised of guide halves 64 and 66. At least one guide half, includes an aperture 76 which extends into the slot 78. In the present embodiment, the aperture 76 is illustrated in the guide half 66. The controller also includes a stopper mechanism 68. Stopper mechanism 68 is comprised of a solenoid 70 which activates the plunger 72. Plunger 72 includes a projection 74 which is dimensioned to pass through the aperture 76 and to impede the movement of the selector 80 within the slot 78 in guide 62. In the presently preferred embodiment, the projection 74 dimensioned to engage an aperture 82 in the selector 80. This provides a positive mechanical stop against further movement of the selector 80. Alternatively, the plunger 72 could merely move into an interfering contact to halt movement of the selector 80. Actuation of the solenoid 70 is accomplished through the electorial lead 71. As noted previously, the passage of electorial current to the lead 71 will be made in accordance with the weave pattern selection process. When it is determined by the weave pattern that a particular heddle should remain in the down position, the solenoid will be activated and the projection 74 will impede movement of the selector 80. As a result, the associated heddle will remain at a down position.

Figure 5:
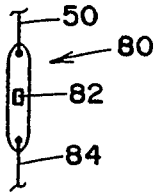
FIG. 5 illustrates a heddle selector in accordance with the present invention.

With reference to FIG. 5, the selector 80 will be described in more detail . The selector 80 will have a configuration very similar to that associated with the heddle 42. However, the selector 80 will have sufficient length so that it will move within the guide 62 without causing abrasion or other alignment problems. Since one end of the selector 80 is connected to the primary lead 50, it will be appreciated that the lengths of the primary lead 50 and the selector 80 must be selected in accordance with the movement necessary to produce the shed opening. In the preferred embodiment, the selector 80 includes an aperture 82 which is dimensioned to receive projection 74. The third lead 84 is affixed to the other end of the selector 82 and is routed as discussed previously.

Figure 6:
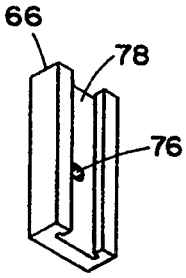
FIG. 6 illustrates a section of the guide in accordance with the present invention.

With respect to FIG. 6, guide half 66 is shown in more detail. From FIG. 6, it can be seen that the aperture 76 is positioned in one wall of the guide. The dimensions of slot 78 will be determined by selector 82 . At present, it is preferred that guide halves 64 and 66 be used to fully encase the selector 80 . However, it is contemplated that the selector 80 could be captured within a single slot as indicated by the phantom lines in FIG. 6.

Figure 7:
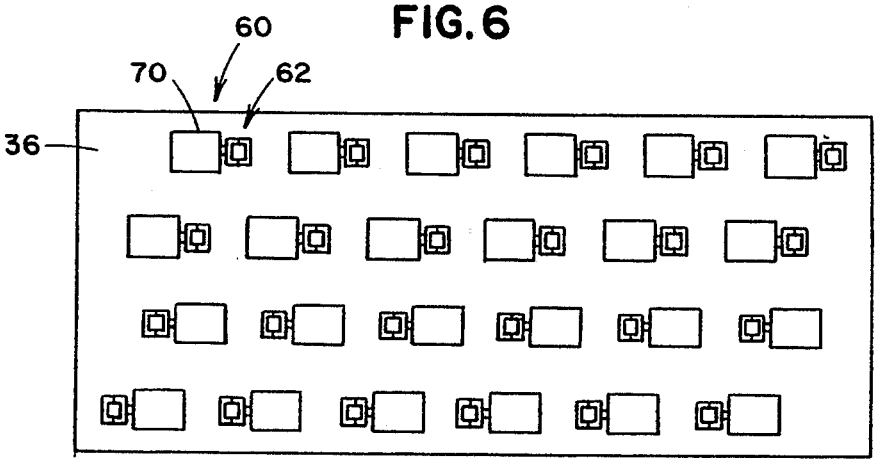
FIG. 7 illustrates one arrangement for a plurality of controllers in accordance with the present invention.

With reference to FIG. 7 , there is illustrated a plurality of controller 70 as they may be positioned on the plate 36. The specific arrangement of the controller 60 is not critical to the present invention. It is intended by FIG. 7 to illustrate the flexibility in special arrangements. In the presently preferred embodiment each controller 60 includes a miniature solenoid which is available from Autotronics, Inc. of Joplin, Miss. Each controller 60, including the guide 62 and the stopper mechanism 68, requires approximately 121 square millimeters on plate 36.

In FIGS. 1, 4 and 7, the controllers have not been depicted as affixed to the plate 36 and the controller has not been shown with the stopper mechanism 68 affixed to the guide 62. Since it is believed such attachments are well within the skill of the art, the specific means of attachment do not require description herein. However, it must be recognized that attachment of the controller 60 to the plate 36 must permit movement of the third lead 84 and the selector 80. For example, each controller 60 may be secured to a generally "L" shaped mount of the type which shown in phantom at 63 on FIG. 4. The mount is removably secured to the guide 62 to permit quick interchange of the elements when necessary.

Figure 8:
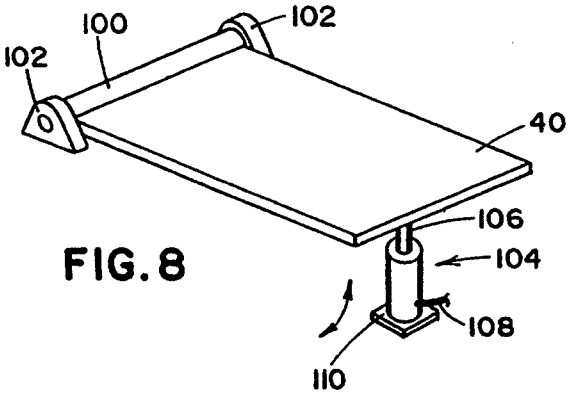
FIG. 8 illustrates a shed formation plate in accordance with the invention.
Figure 9:
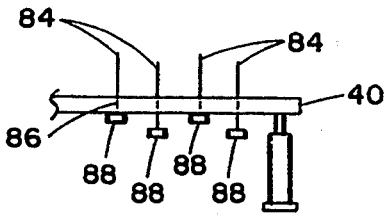
FIG. 9 illustrates a shed formation plate and varied lead positions in accordance with the invention.

With reference to FIGS. 8 and 9, the shed formation plate 40 will be described in more detail. Plate 40 is secured to the roller 100 which is mounted for rotation at its ends in the mounts 102. The mounts 102 may be affixed to the floor, a cross member or some other portion of the weaving apparatus to fix them against movement. The free end of plate 40 is secured to a solenoid 104. Solenoid 104 will move through an arc, as indicated by the arrows in FIG. 8, which will generally translate into vertical movement of the secondary leads 84. In view of the fact that the roller 100 must rotate, it will be understood by those skilled in the art that either the attachment of plunger 106 to plate 40 or the attachment of solenoid 104 to the base 110 must be a moving attachment to accommodate the arcuate movement of plate 40. As noted previously, the solenoid 104 will be activated on each pass of the shed formation apparatus. The actuation of the solenoid 104 is accomplished through the cad 108. As will be recognized by those skilled in the art, mechanical, pneumatic, hydraulic or other electrical—electronic means may be used in place of the solenoids described herein.

With reference to FIG. 9, there is shown a side view of the plate 40 which illustrates the position of representative third leads 84 during a weaving operation. In the preferred embodiment, each third lead 84 passes through an aperture 86. The end of the lead 84 is terminated and a small weight 88 is affixed thereto. Thus, the weight 88 also serves as the termination of the lead 84. The principle purpose of the weight 88 is to retain the lead 84 in a generally vertical condition. As noted previously, a selected heddle will not return to the original plane of the yarns 12. Since the projection 74 retards movement of the heddle selector 80, the lead 84 is unloaded. In order to avoid entanglement and to retain the generally vertical position of the lead 84, the weight 88 is attached. As will be understood by those skilled in the art, the weight 88 does not need to be substantial, however, the attachment to lead 84 must be secure in order to maintain control during movement of the plate 40. Still with reference to FIG. 9, it will be understood by those skilled in the art that the plate 40 will traverse an arcuate path and the stroke length of the plunger 106 must be considered in positioning the selector 80 with respect to the respective stopper mechanism 68.

At present, it is preferred to use electrically operated solenoids in connection with the present invention. Since each solenoid does not have to be activated on each pass, the electrical load of the present invention is greatly reduced. In addition, electrical switching devices which are controlled by punch cards or computer information are relatively common. Accordingly, the use of solenoids eliminates the need for conversion of data from an electrical format to some other format.

It will be understood by those skilled in the art that variations in the preferred embodiment will still come within the scope of the claimed invention.

We claim:

1. A shed formation apparatus comprised of:

a plurality of movable heddles;

a plurality of heddle selectors connected to the moveable heddles by a first plurality of control leads;

a plurality of heddle selector controllers which include stopper means for retarding the movement of the heddle selectors;

a first harness means, including a plurality of passages through which the first plurality of control leads pass, to increase the spacing between the control leads;

a first plurality of control frames, to which the controllers are mounted, equal in number to the control leads, each frame including a through slot which is intersected by a passageway that extends through one wall of the frame;

each heddle selector being movable in the through slot in a respective controller and further including an aperture which is alignable with the respective passageway;

the stopper means each include an extendable-retractable piston affixed to the wall of the control frame and are positioned so that the extended piston can be passed through the passageway and then through the aperture;

a second plurality of control leads attached to the heddle selectors;

a second harness means, including a plurality of passages through which the second plurality of control leads pass; and repeat pattern output means that determines the movement of the second plurality of control leads and, thereby, the movement of the heddle selectors, and selectively activates the stopper means.

2. A shed formation apparatus comprised of:

a plurality of movable double ended heddles;

a plurality of heddle selectors connected to the moveable heddles by a first plurality of control leads;

a plurality of heddle selector controllers which include stopper means for retarding the movement of the heddle selectors;

a first harness means, including a plurality of passages through which the first plurality of control leads pass, to increase the spacing between the first plurality of control leads;

a second plurality of control leads attached to the heddle selectors;

a second harness means including a plurality of passages through which the second plurality of control leads pass to reduce the spacing between the second plurality of control leads;

a third plurality of control leads affixed to the opposite ends of the heddles from first plurality of control leads; and repeat pattern output means that determines the movement of the second plurality of control leads and, thereby, the movement of the heddle selectors, and selectively activates the stopper means.

3. A method for forming a shed opening in an array of yarns comprising:

providing a shed formation apparatus having a plurality of moveable heddles, a plurality of heddle selectors which are connected to the moveable heddles by a first plurality of control leads, and a plurality of heddle selector controllers which include stopper means for retarding the movement of the heddle selectors;

providing a repeat pattern output means that determines the movement of the heddle selectors and selectively activates the stopper means;

providing a resilient means for biasing the heddle selectors toward a first position;

providing a second plurality of control leads which are attached to the heddle selectors;

threading respective yarns from the array through the respective heddles, wherein the improvement is characterized by:

providing a first harness means, including a plurality of passages through which the first plurality of control leads pass, to increase the spacing of the control leads, and a moveable common plane in which the second plurality of control leads are terminated, movement of the common plane is controlled by the repeat pattern output means;

moving the common plane, and therefore the plurality of control leads to move the heddle selectors from the first position to a second position;

selectively activating the stopper means in selected controllers in accordance with the repeat pattern output means to retard the movement of the selected heddle selectors, and therefore their associated heddles and yarns, from the second position; and, permitting the common plane to return to its initial position after the selected controllers have been activated such that the resilient means move the non-selected heddle selectors and their associated heddles and yarns back to the first position to form the shed opening.

4. A shed formation apparatus comprised of:

a plurality of movable heddles;

a plurality of heddle selectors which are connected to the moveable heddles by a first plurality of control leads;

a plurality of controllers which are located on a common plane, are connected to the heddle selectors and include stopper means for retarding the movement of the heddle selectors;

a resilient means connected to the heddle selectors for biasing the heddle selectors to an initial position;

a second plurality of control leads attached to the heddle selectors; and repeat pattern output means that selectively activates the stopper means controls the movement of a movable common plane in which the second plurality of control leads are terminated and, thereby, the movement of the second plurality of control leads.

5. The apparatus of claim 4 further comprising a third plurality of control leads connected to the heddles, the resilient means are connected to the third plurality of control leads.

* * * * *

UNITED STATES PATENT AND TRADEMARK OFFICE

CERTIFICATE OF CORRECTION

PATENT NO. : 5,355,911
DATED : October 18, 1994
INVENTOR(S) : Heinz Kuster, et. al.

It is certified that error appears in the above-indentified patent and that said Letters Patent is hereby corrected as shown below:

Column 1, line 14, replace "format ion" with -- formation --.
Column 5, line 14, insert -- is -- after 74--.
Column 5, lines 20 and 21, replace "electorial" with --electrical --.
Column 6, line 6, insert --is-- after "which"--.
Column 8, line 52, insert -- , -- after "means"--.

Signed and Sealed this

Seventh Day of March, 1995

*Attest:*

Bruce Lehman

BRUCE LEHMAN

*Attesting Officer*

*Commissioner of Patents and Trademarks*